United States Patent [19]

Price

[11] 4,242,060

[45] Dec. 30, 1980

[54] FOOT PUMPS

[75] Inventor: Ernest J. Price, Solihull, England

[73] Assignee: E. J. Price (Developments) Limited, Birmingham, United Kingdom

[21] Appl. No.: 905,559

[22] Filed: May 12, 1978

[30] Foreign Application Priority Data

May 13, 1977 [GB] United Kingdom ..... 20096/77

[51] Int. Cl.[3] ..... F04B 19/02

[52] U.S. Cl. ..... 417/464; 417/903

[58] Field of Search ..... 417/464, 903

[56] References Cited

FOREIGN PATENT DOCUMENTS 354573 8/1931 United Kingdom ..... 417/464

1471884 4/1977 United Kingdom ..... 417/903

*Primary Examiner*—William L. Freeh

*Attorney, Agent, or Firm*—Scrivener, Parker, Scrivener and Clarke

[57] ABSTRACT

A foot pump comprises a base member and an operating member pivotally connected to the base member. A piston-and-cylinder assembly is connected between the members. In use the user depresses the operating member with his or her foot, thereby causing air to be compressed in and expelled from said assembly. A return spring incorporated in said assembly returns the operating member to its raised position. The assembly can be disconnected from the base member and connected to the base member again, at will, and the whole is so arranged that when the assembly is disconnected from the base member the pump can assume a storage position in which the operating member is in a depressed position and the return spring is not loaded, or at least not significantly loaded.

5 Claims, 6 Drawing Figures

FOOT PUMPS

Figure 1:
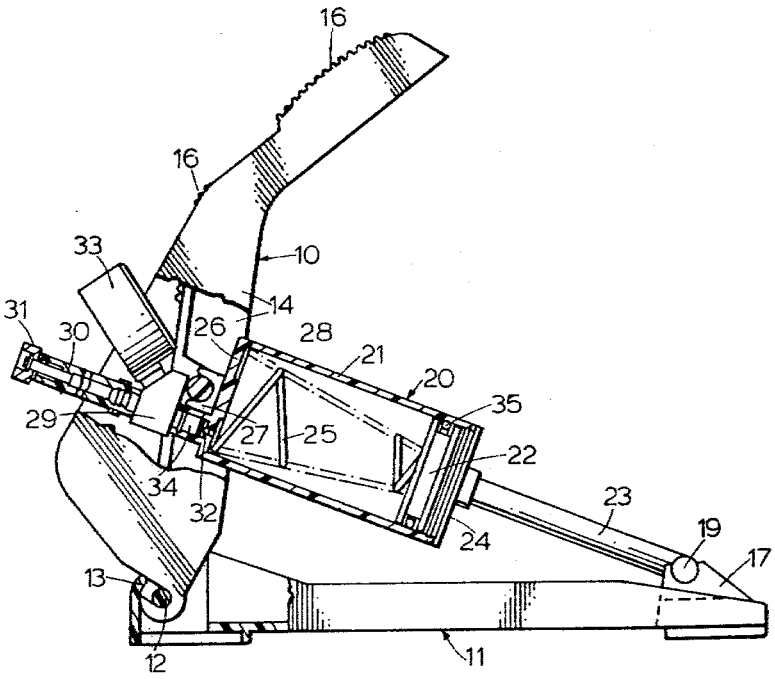

This invention relates to foot pumps, and in particular to foot pumps of the kind (hereinafter referred to as the kind specified) comprising a base member, an operating member pivotally connected to the base member and which in use can be depressed by the user's foot from a raised position, a piston-and-cylinder assembly connected between the operating member and the base member and operative to compress or expel air when the operating member is depressed from its raised position, and return spring means incorporated in the piston-and-cylinder assembly operative in normal use to be loaded by depression of the operating member from its raised position and to urge the operating member towards its raised position. Such foot pumps are in general use for the inflation of the tyres of motor vehicles, though they may be used for other purposes, such as the inflation of air-beds, toy balls and other articles.

When a foot pump is not in use it is desirable for it to be stored or carried in a relatively compact state, and to this end it is usual for the upper member to be depressed, against the action of the return spring means, and for it to be releasably retained in a storage state by means of a catch. It is not always easy for the user to manipulate the catch when the return spring means is loaded, and if the catch is inadvertently released the return spring means operates to urge the operating member to its raised position.

An object of the present invention is to overcome or reduce those problems.

According to the present invention there is provided a foot pump of the kind specified characterised in that there is releasable connecting means operative to enable said assembly to be disconnectably connected to the base member for normal use of the pump, the arrangement being such that when said connecting means is disconnected the operating member can be depressed from its raised position, to enable the pump to assume a storage position, without causing the loading of the return spring means that occur in normal use.

Preferably the piston-and-cylinder assembly comprises a cylinder pivotally connected to the operating member and a piston with a piston rod releasable connected to the base member. Preferably the releasable connecting means comprises laterally projecting trunnions on the piston rod and complementary bearings on the base member operative for releasable connection with said trunnions, and operative to permit relative rotational movement between said trunnions and said bearings when said trunnions are connected with said bearings. In a preferred arrangement the trunnions can be snapped into engagement with said bearings. The arrangement is also preferably such that when the foot pump is in use, with the piston-and-cylinder connected to both frames, depression of the upper member tends to urge the trunnions in a direction contrary to that in which the trunnions can be removed from the bearings. When the foot pump is no longer in use, and the return spring means has returned the operating member to its raised position, the trunnions can be pulled out of engagement with the bearings, the movement of the trunnions out of the bearings possibly involving slight, temporary loading of the return spring means.

The pump is preferably so arranged that when it is in its storage position said trunnions and the adjacent part of the piston rod project beyond said members, thereby enabling the trunnions to be used as a handle.

It is desirable to provide catch means operative to retain the piston rod detachably in position relative to at least one of the members when the pump is in its storage position. The catch means is preferably so disposed as to engage the piston rod automatically when the pump is moved to its storage position but is unable to engage the piston rod when the piston-and-cylinder assembly is connected to the base member by means of said releasable connecting means. Conveniently the catch means comprises a slot or groove in at least one of said member, the dimensions of said slot or groove being such that when the piston rod enters said slot or groove it is releasably retained in it.

Figure 2:
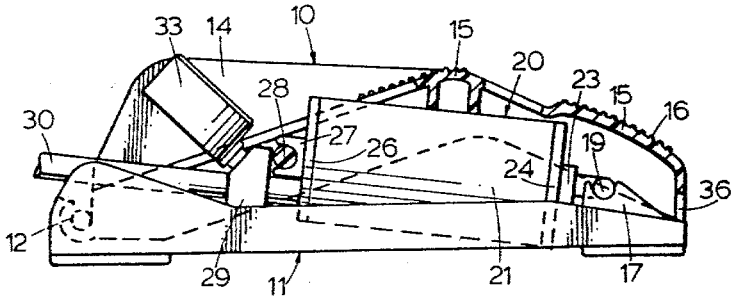
Figure 3:
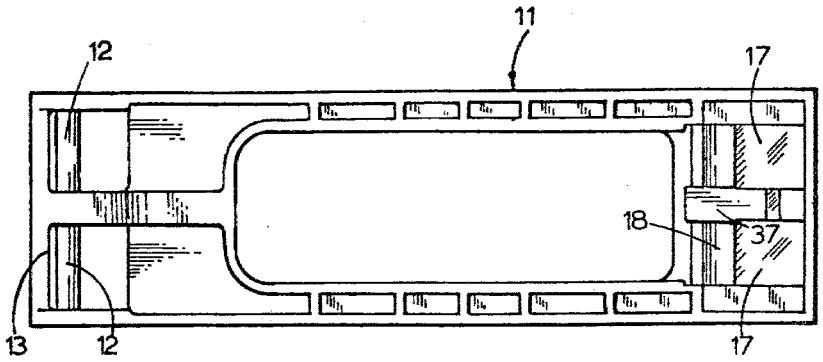
Figure 4:
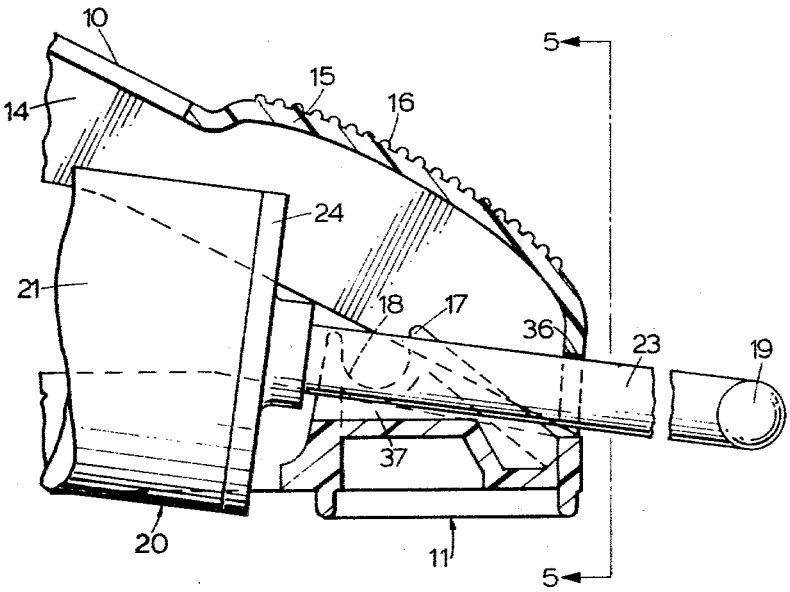
Figure 5:
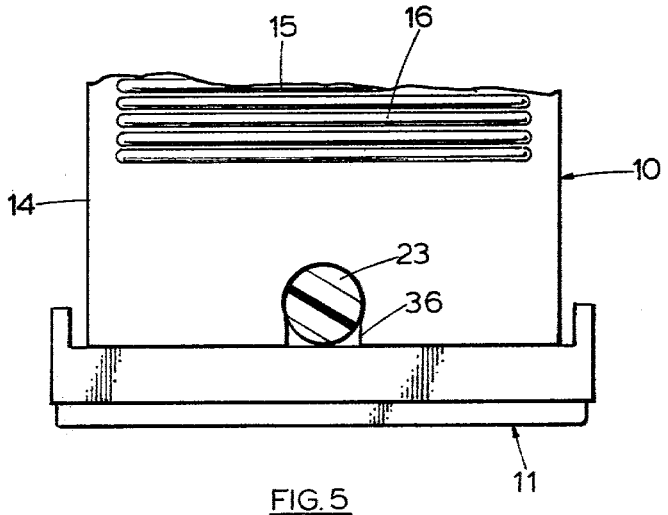
Figure 6:
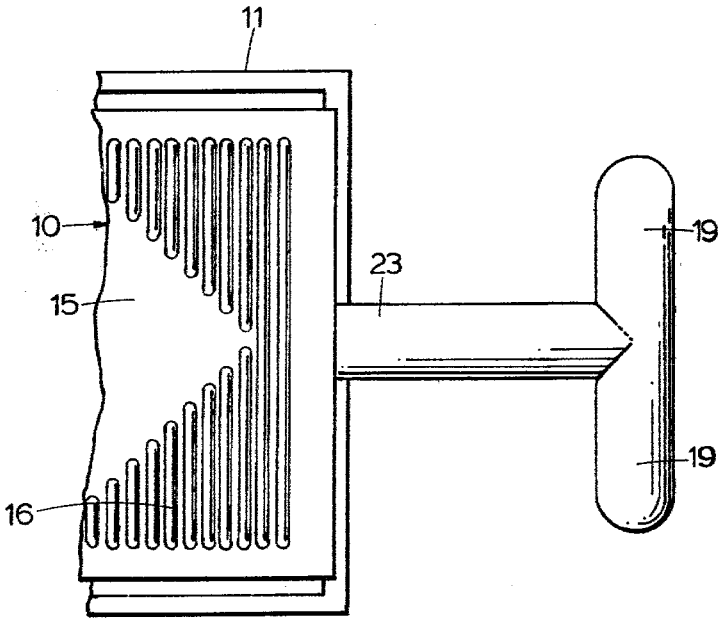

An embodiment of the invention is illustrated, by way of example, in the accompanying drawings, in which:

FIG. 1 is a side view of a foot pump embodying the present invention, certain parts being broken away to reveal parts that would otherwise be hidden, the foot pump being in its state of use and with the operating member in its raised position, FIG. 2 is a view similar to FIG. 1 but showing the operating member depressed, FIG. 3 is a plan view of the base member of the foot pump, FIG. 4 is a section, to a larger scale, of one end of the pump shown in FIG. 2, with the pump in its storage position, FIG. 5 is a section along the line 5—5 of FIG. 4, and FIG. 6 is a plan view corresponding to FIG. 4.

The foot pump illustrated comprises an operating member 10 and a base member 11 each made as a unitary moulding from a plastics material such as talc-filled polypropylene. The members 10 and 11 are pivoted together about the axis of a pivot pin 12. Upward movement of the operating member 10 beyond the position shown in FIG. 1, in which the operating member is in its raised position, is prevented by the engagement between the operating member and an abutment 13 on the base member.

The operating member 10 is formed with spaced parallel side parts 14, which serve to stiffen the member, and transverse parts 15. Those transverse parts 15 further from the pivot pin 12 are ribbed as indicated at 16 on their upper surfaces for engagement with the sole of the user's shoe.

The base member 11 is of rectangular shape in plan, and the central part of the base member is open. Near one end of the base member 11 are the pivot pin 12 and the abutment 13, both of which constitute integral parts of the base member. Near the other ends of the base member is a pair of upstanding lugs 17 formed with coaxial grooves 18 affording bearings for cylindrical trunnions 19 on a piston-and-cylinder assembly 20 described in more detail below. The mouths of the grooves 18 are a little narrower than the interiors thereof so that the trunnions 19 have to be pressed past them to snap or clip into the grooves fully, and thus to engage the bearings. The trunnions 19 and grooved lugs 17 constitute the releasable connecting means referred to above.

The piston-and-cylinder assembly 20 comprises a cylinder 21 containing a piston 22. The piston is connected to a piston rod 23 which projects through a hole in an end plate 24 secured to the cylinder. The trunnions 19 are formed at that end of the piston rod 23 further from the piston 22. The cylinder 21 also contains a helical compression spring 25, the overall shape of which is frusto-conical. The spring 25 acts as a return spring and constitutes the return spring means referred to above. The broader end of the spring bears against the end 26 of the cylinder, while the narrower end thereof bears against the piston 22, being located in a shallow recess in the end of the piston. When the piston 22 is unrestrained the spring 25 urges it against the end plate 24, and the piston rod 23 extends to the position shown in FIG. 1. The end 26 of the cylinder carries a pair of formations 27 on its outer face, each of the formations having a longitudinally extending channel which receives a pivot rod 28 formed integrally with the operating member 10. A junction component 29 is connected to the end 26 of the cylinder 21 and leads to a flexible tube 30 terminating in a connector 31 for connection to the valve of a motor-vehicle tyre in the usual way. A non-return valve 32 is disposed in the junction component 29 and operates to prevent air under pressure returning into the cylinder. The junction component 29 also carries a pressure gauge 33 which serves to indicate the pressure of the air in the flexible tube 30. The junction component 29 has a tubular portion 34 which, during assembly, snaps into an outwardly projecting tube formed integrally with the end 29 of the cylinder 21.

During assembly of the pump the tubular portion 34 is snapped into the tube and is rotated to a position such that the piston-and-cylinder assembly 20 can be assembled with the pivot rod 28, the rod entering the grooves in the formations 27. The junction component 29 is then rotated to the position illustrated in FIGS. 1 and 2, and the pressure gauge 33 is attached to it. The diameter of the gauge is such that any subsequent attempt to rotate the junction component 29 is prevented by the engagement between the gauge and the side parts 14 of the operating member. As can be seen in FIG. 1, the junction component has a face which, when the component is in its final position, abuts the pivot rod 28 and thus prevents the removal of the pivot rod 28 from the grooves in the formations 29. This construction provides a simple and positive means for effecting pivotal connection between the piston-and-cylinder assembly 20 and the operating member 10.

In an alternative construction (not illustrated) the gauge is omitted, and the junction component 29 is replaced by a simple tubular component which does not extend into the neighbourhood of the pivot rod 28. The formations 27 are modified in shape so that the mouths of the grooves in them are slightly narrower than the diameter of the pivot rod. During assembly the pivot rod 28 is snapped into the grooves and is retained there merely by the shape of the formations themselves. Such an arrangement is normally less satisfactory than that illustrated as it is less positive in its retention of the pivot rod in the grooves.

The piston carries a ring 35 which co-operates with the interior of the cylinder in a well-known manner and such that in use when the piston 22 is pushed along the cylinder against the action of the return spring 25, air is forced in front of the piston, is compressed and is expelled through the flexible tube 30.

In normal use, when the base member 11 stands on the ground, the pump assumes the position shown in FIG. 1, in which the operating member 10 is in its raised position. The operating member can then be depressed by the user's foot so that the pump assumes the position shown in FIG. 2, in which the piston has travelled to the far end of the cylinder. When the user raises his or her foot the pump returns to the position shown in FIG. 1 due to the expansion of the return spring. The spring is still slightly compressed when the pump is in this position, and the piston is spaced slightly away from the end plate 24. It will be observed that throughout these movements the spring 25 urges the trunnions 19 into the grooves 18 in the lugs 17, and urges the formation 27 into engagement with the pivot rod 28.

When the pump is no longer required for immediate use, the user can pull the trunnions 19 from the grooves 18. During this movement the return spring 25 is compressed slightly more, but the force involved is negligible compared with that required to pull the trunnions from the groove.

As soon as the trunnions 19 are raised above the lugs 17 the operating member 10 can be lowered to a storage position largely similar to the depressed position shown in FIG. 2, but in which the piston rod 23 remains projecting fully from the cylinder 21, so that the return spring is not compressed as it is when the pump is in the position illustrated. Part of the piston rod 23 lies between the lugs 17, while the end part of the piston rod, carrying the trunnions 19, projects well beyond the ends of the members 10 and 11 as shown in FIG. 4. The trunnions 19, being spaced from the members 10 and 11 can then be used as a handle with which the pump can be carried.

Catch means is provided to retain the piston rod 23 detachably in position relative to one or both of the members 10 and 11 when the pump is in its storage position. This prevents or assists in preventing the pump from inadvertently assuming an open position in which the members 10 and 11 swing apart; obviously, when it is necessary to carry and otherwise handle the pump, this can be effected more readily when it is retained in its storage position than when it is able to assume an open position in which the members 10 and 11 and the piston-and-cylinder assembly can swing apart.

As shown in FIG. 5, that end of the operating member further from the pivotal connection between the members is formed with a slot 36. The mouth of the slot is a little narrower than the diameter of the piston rod 23 so that the piston rod automatically snaps into the slot 36 as the operating member 10 is moved to its storage position. In normal use, when the trunnions 19 are disposed in the grooves 17 as shown in FIG. 2, the piston rod does not extend as far as the slot 36, so there is then no engagement between the rod and the slot.

In addition, as the operating member 10 approaches the storage position the piston rod 23 is pushed downwards into a longitudinal groove 37 between the lugs 17 where it is releasably held in place by friction, the groove 37 being very slightly narrower than the rod 23. The frictional engagement of the rod not only prevents the rod being inadvertently removed from the groove 37, but also prevents longitudinal movement of the rod. This in turn prevents the operating member 10 being raised. In view of this, the slot 36 may be modified, if desired, so that its mouth is broader than the rod and it merely receives the rod 23 without engaging it in such a manner as to resist its being withdrawn from the slot.

Alternatively the mouth of the groove 37 may be narrower than the rod 23, while the interior of the groove 37 is broader than the rod. In that case the rod snaps into the groove automatically when the operating member 10 is moved to its storage position. The rod 23 is then located in the groove but can move longitudinally in it. It is therefore desirable in such a case to provide the slot 36 with a narrow mouth again, so that both the members 10 and 11 are in snap engagement with the rod 23.

It will be appreciated from a comparison between FIGS. 2 and 4 that in normal use the rod 23 does not enter the groove 37, between the lugs 17, sufficiently far to become engaged in that groove.

When the pump is to be used against the piston rod 23 is pulled from the slots 36 and groove 37, the operating member 10 is raised and the trunnions 19 are snapped or clipped into the grooves 18.

I claim:

1. In a foot pump of the kind comprising a base member, an operating member pivotally connected to the base member and while in use can be depressed by the user's foot from a raised position, a piston-and-cylinder assembly connected between the operating member and the base member and operative to compress or expel air when the operating member is depressed, and return spring means incorporated in the piston-and-cylinder assembly and operative in normal use to be loaded by depression of the operating member from its raised position and to urge the operating member towards its raised position, the invention comprising a first connection pivotally connecting said cylinder to the operating member and a second releasable connection pivotally connecting said piston rod to the base member, the arrangement being such that when said second connection is released from the base member the operating member can be depressed from its raised position to enable the pump to assume a storage position without causing the loading of the return spring means that occurs in normal use, catch means carried by one of said members and being so disposed as to detachably engage the piston rod automatically when the pump is moved to its storage position to retain said rod in said storage position, said catch means being also disposed on said one member that it is unable to engage the piston rod when the piston-and-cylinder assembly is connected to the base member by said second releasable connecting means.

2. A foot pump according to claim 1 in which the catch means comprises a slot or groove in at least one of said members, the dimensions of said slot or groove being such that when the piston rod enters said slot or groove it is releasably retained in it.

3. A foot pump according to claim 1 in which said second releasable connection comprises laterally projecting trunnions on the piston rod and complementary bearings on the base member operative for releasable connection with said trunnions, and being operative to permit relative rotational movement between said trunnions and said bearings when said trunnions are connected with said bearings.

4. A foot pump according to claim 3 in which said trunnions can be snapped into engagement with said bearings.

5. A foot pump according to claim 3 in which, when the pump is in its storage position said trunnions and the adjacent part of the piston rod project beyond said members, thereby enabling the trunnions to be used as a carrying handle for said pump.

* * * * *